US009506336B2

(12) United States Patent
Orbell

(10) Patent No.: US 9,506,336 B2
(45) Date of Patent: Nov. 29, 2016

(54) METHOD AND APPARATUS FOR DRILLING SUBTERRANEAN BOREHOLE

(75) Inventor: Charles Orbell, Melbourne Beach, FL (US)

(73) Assignee: MANAGED PRESSURE OPERATIONS PTE LTD, Singapore (SG)

( * ) Notice: Subject to any disclaimer, the term of this patent is extended or adjusted under 35 U.S.C. 154(b) by 615 days.

(21) Appl. No.: 13/885,974

(22) PCT Filed: Nov. 16, 2011

(86) PCT No.: PCT/GB2011/052232

§ 371 (c)(1),
(2), (4) Date: Mar. 20, 2014

(87) PCT Pub. No.: WO2012/066325

PCT Pub. Date: May 24, 2012

(65) Prior Publication Data

US 2014/0202766 A1 Jul. 24, 2014

Related U.S. Application Data

(60) Provisional application No. 61/414,248, filed on Nov. 16, 2010.

(51) Int. Cl.

| | |
|---|---|
| ***E21B 44/04*** | (2006.01) |
| ***E21B 21/08*** | (2006.01) |
| ***E21B 44/00*** | (2006.01) |

(52) U.S. Cl.

CPC ..... *E21B 44/04* (2013.01); *E21B 21/08* (2013.01); *E21B 44/00* (2013.01)

(58) Field of Classification Search

CPC ..... E21B 21/08; E21B 44/00; E21B 44/005; E21B 44/04; E21B 45/00; E21B 49/003

See application file for complete search history.

(56) References Cited

U.S. PATENT DOCUMENTS

| | | | |
|---|---|---|---|
| 704,423 | A | 7/1902 | Allen |
| 1,491,986 | A | 4/1924 | Greene |
| 2,102,555 | A | 12/1937 | Dyer |
| 2,158,356 | A | 5/1939 | Dyer |

(Continued)

FOREIGN PATENT DOCUMENTS

| | | | |
|---|---|---|---|
| EP | 1227215 | B1 | 7/2002 |
| EP | 1248065 | A2 | 10/2002 |

(Continued)

OTHER PUBLICATIONS

Co-pending U.S. Appl. No. 13/262,595, filed Sep. 30, 2011.

(Continued)

*Primary Examiner* — Daniel P Stephenson
(74) *Attorney, Agent, or Firm* — Norman B. Thot

(57) ABSTRACT

A method of drilling a subterranean bore hole comprising a) pumping a drilling fluid down a drill string, the drill string having a drill bit at an end thereof, b) rotating the drill string about its longitudinal axis to that the bit forms bore hole in the ground, the method further comprising the steps of: c) changing the rate of pumping of the drilling fluid into the drill string in response to a change in the speed of rotation of the drill string, and/or changing the speed of rotation of the drill string in response to a change in the rate of pumping of the drilling fluid into the drill string.

16 Claims, 3 Drawing Sheets

(56) References Cited

U.S. PATENT DOCUMENTS

| | | | | |
|---|---|---|---|---|
| 3,298,385 | A | 1/1967 | Jackson et al. | |
| 3,338,319 | A | 8/1967 | Griffin, III | |
| 3,470,971 | A | 10/1969 | Dower | |
| 4,448,267 | A | 5/1984 | Crawford, III et al. | |
| 4,630,675 | A | 12/1986 | Neipling et al. | |
| 4,685,520 | A | 8/1987 | McDaniel | |
| 4,770,389 | A | 9/1988 | Bodine et al. | |
| 4,823,877 | A | 4/1989 | McDaniel et al. | |
| 4,867,254 | A | 9/1989 | Gavignet | |
| 5,070,949 | A | 12/1991 | Gavignet | |
| 5,080,182 | A | 1/1992 | Thompson | |
| 5,115,871 | A | 5/1992 | McCann et al. | |
| 5,431,188 | A | 7/1995 | Cove | |
| 5,628,493 | A | 5/1997 | McKnight et al. | |
| 5,975,219 | A | 11/1999 | Sprehe | |
| 6,050,348 | A | 4/2000 | Kuttel et al. | |
| 6,109,368 | A * | 8/2000 | Goldman | E21B 12/02 175/39 |
| 6,176,323 | B1 | 1/2001 | Weirich et al. | |
| 6,206,108 | B1 * | 3/2001 | MacDonald | E21B 44/00 175/24 |
| 6,244,631 | B1 | 6/2001 | Payne et al. | |
| 6,315,051 | B1 | 11/2001 | Ayling | |
| 6,374,925 | B1 | 4/2002 | Elkins et al. | |
| 6,427,125 | B1 * | 7/2002 | Gzara | E21B 21/08 702/9 |
| 6,527,062 | B2 | 3/2003 | Elkins et al. | |
| 6,575,244 | B2 | 6/2003 | Chang et al. | |
| 6,814,142 | B2 | 11/2004 | Paulk et al. | |
| 6,904,981 | B2 | 6/2005 | Van Riet | |
| 7,044,237 | B2 | 5/2006 | Leuchtenberg | |
| 7,044,239 | B2 * | 5/2006 | Pinckard | E21B 44/02 175/24 |
| 7,107,875 | B2 | 9/2006 | Haugen et al. | |
| 7,185,719 | B2 | 3/2007 | Van Riet | |
| 7,395,878 | B2 | 7/2008 | Reitsma et al. | |
| 7,836,973 | B2 | 11/2010 | Belcher et al. | |
| 7,984,770 | B2 | 7/2011 | Sehsah | |
| 8,122,975 | B2 | 2/2012 | Belcher et al. | |
| 8,360,170 | B2 | 1/2013 | Leuchtenberg | |
| 2003/0079912 | A1 | 5/2003 | Leuchtenberg | |
| 2003/0168258 | A1 | 9/2003 | Koederitz | |
| 2004/0154805 | A1 * | 8/2004 | Fontana | E21B 21/08 166/358 |
| 2005/0092523 | A1 | 5/2005 | McCaskill et al. | |
| 2006/0060360 | A1 | 3/2006 | Moncus et al. | |
| 2006/0124352 | A1 | 6/2006 | Krueger et al. | |
| 2006/0157282 | A1 | 7/2006 | Tilton et al. | |
| 2006/0254822 | A1 | 11/2006 | Ayling | |
| 2006/0278434 | A1 | 12/2006 | Calderoni et al. | |
| 2007/0151762 | A1 | 7/2007 | Reitsma | |
| 2007/0231158 | A1 | 10/2007 | Butler et al. | |
| 2008/0105434 | A1 | 5/2008 | Orbell et al. | |
| 2009/0025930 | A1 | 1/2009 | Iblings et al. | |
| 2009/0139767 | A1 | 6/2009 | Jeffryes | |
| 2009/0242817 | A1 | 10/2009 | Strazhgorodskiy | |
| 2012/0090893 | A1 | 4/2012 | Leuchtenberg | |
| 2012/0118638 | A1 | 5/2012 | Orbell et al. | |
| 2014/0090888 | A1 * | 4/2014 | Smith | E21B 21/106 175/38 |
| 2014/0202766 | A1 * | 7/2014 | Orbell | E21B 21/08 175/27 |
| 2014/0277752 | A1 * | 9/2014 | Chang | E21B 44/00 700/275 |

FOREIGN PATENT DOCUMENTS

| | | | |
|---|---|---|---|
| EP | 1048819 | B1 | 2/2004 |
| EP | 1754947 | A2 | 2/2007 |
| GB | 2119046 | A | 11/1983 |
| GB | 2290330 | A | 12/1995 |
| GB | 2314106 | A | 12/1997 |
| GB | 2354783 | A | 4/2001 |
| GB | 2426274 | A | 11/2006 |
| GB | 2427217 | A | 12/2006 |
| GB | 2451699 | A | 2/2009 |
| JP | 2007174548 | A | 7/2007 |
| WO | 0236928 | A1 | 5/2002 |
| WO | 0250398 | A1 | 6/2002 |
| WO | 2004048747 | A1 | 6/2004 |
| WO | 2004074627 | A1 | 9/2004 |
| WO | 2005019596 | A1 | 3/2005 |
| WO | 2005080745 | A1 | 9/2005 |
| WO | 2007005822 | A2 | 1/2007 |
| WO | 2007/016000 | A1 | 2/2007 |
| WO | 2007081711 | A2 | 7/2007 |
| WO | 2007124330 | A2 | 11/2007 |
| WO | 2008051978 | A1 | 5/2008 |
| WO | 2008095650 | A1 | 8/2008 |
| WO | 2008156376 | A1 | 12/2008 |
| WO | 2009018173 | A2 | 2/2009 |
| WO | 2009022914 | A1 | 2/2009 |
| WO | 2010046653 | A2 | 4/2010 |

OTHER PUBLICATIONS

Hutchinson and Cooper "Using Downhole Annular Pressure Measurements to Anticipate Drilling Problems" SPE 49114, 1998 SPE Annual Technical Conference and Exhibition, New Orleans, LA, Sep. 27-30, 1998, pp. 535-549.

International Search Report for GB0905633.4 dated Aug. 10, 2009, 1 pg.

International Search Report for GB0905802.5 dated Jul. 31, 2009, 2 pgs.

International Search Report for PCT/EP2010/054387 dated Oct. 11, 2010, 3 pgs.

International Search Report for PCT/EP2010/063579 dated Nov. 3, 2010, 4 pgs.

International Search Report for PCT/GB2010/050571 dated Dec. 29, 2010, 6 pgs.

International Search Report for PCT/GB2011/052234 dated Jun. 5, 2013, 2 pgs.

Notice of Allowance for co-pending U.S. Appl. No. 13/223,676 dated Nov. 22, 2013.

Schubert and Wright "Early Kick Detection Through Liquid Level Monitoring in the Wellbore" IADC/SPE 39400, 1998 IADC/SPE Drilling Conference, Dallas, TX, Mar. 3-6, 1998, pp. 889-895.

Skalle and Podio "Trends extracted from 800 Gulf Coast blowouts during 1960-1996" IADC/SPE 39354, 1998 IADC/SPE Drilling Conference, Dallas, TX, Mar. 3-6, 1998, pp. 539-546.

Tian et al. "Parametric Analysis of MPD Hydraulics", IADC/SPE 108354-PP, 2007 IADC/SPE Managed Pressure Drilling and Underbalanced Operations Conference and Exhibition, Galveston, TX, Mar. 28-29, 2007, 7 pgs.

PCT International Search Report and Written Opinion (PCT/GB2011/052232), dated May 2, 2013.

* cited by examiner

METHOD AND APPARATUS FOR DRILLING SUBTERRANEAN BOREHOLE

FIELD OF THE INVENTION

The present invention relates to a method of drilling a subterranean borehole.

DESCRIPTION OF THE PRIOR ART

The drilling of a borehole or well is typically carried out using a steel pipe known as a drill pipe or drill string with a drill bit on the lowermost end. The drill string comprises a series of tubular sections, which are connected end to end.

The entire drill string may be rotated using a rotary table, or using an over-ground drilling motor mounted on top of the drill pipe, typically known as a 'top-drive', or the drill bit may be rotated independently of the drill string using a fluid powered motor or motors mounted in the drill string just above the drill bit. As drilling progresses, a flow of mud is used to carry the debris created by the drilling process out of the borehole. Mud is pumped down the drill string to pass through the drill bit, and returns to the surface via the annular space between the outer diameter of the drill string and the borehole (generally referred to as the annulus). The mud flow also serves to cool the drill bit, and to pressurise the borehole, thus substantially preventing inflow of fluids from formations penetrated by the drill string from entering into the borehole. Mud is a very broad drilling term and in this context it is used to describe any fluid or fluid mixture used during drilling and covers a broad spectrum from air, nitrogen, misted fluids in air or nitrogen, foamed fluids with air or nitrogen, aerated or nitrified fluids to heavily weighted mixtures of oil and or water with solid particles.

Significant pressure is required to drive the mud along this flow path, and to achieve this, the mud is typically pumped into the drill string using one or more positive displacement pumps which are connected to the top of the drill string via a pipe and manifold. The rate of mud circulation down the drill pipe and up through the well bore is thus determined by the speed of operation of these pumps.

The pressure of the mud at the bottom of the well bore (the "bottom hole pressure" or BHP) is usually monitored in an effort to ensure that it is sufficient to minimise or eliminate the risk of formation fluid from entering the well bore in an uncontrolled manner generally known as a "kick", and also to ensure that it is not so high that there is a risk of fracturing the formation and/or forcing mud into the formation.

Whilst the main mud flow into the well bore is achieved by pumping mud into the main bore at the very top end of the drill string, it is also known to provide the drill string with a side bore which extends into the main bore from a port provided in the side of the drill string, so that mud can be pumped into the main bore at an alternative location to the top of the drill string.

For example, as drilling progresses, and the bore hole becomes deeper and deeper, it is necessary to increase the length of the drill string, and this is typically achieved by disengaging the top drive from the top of the drill string, adding a new section of tubing to the drill string, engaging the top drive with the free end of the new tubing section, and then recommencing drilling. It will, therefore be appreciated that if pumping of mud down the drill string takes place solely via the main bore at the very top end of the drill string, it would be necessary for pumping to cease during this process.

Stopping mud flow in the middle of the drilling process is problematic for a number of reasons, and so it has been proposed to facilitate continuous pumping of mud through the drill string via the side bore in each section of drill string. This means that mud can be pumped into the drill string via the side bore whilst the top of the drill string is closed, the top drive disconnected and the new section of drill string being connected.

In one such system, disclosed in U.S. Pat. No. 2,158,356, at the top of each section of drill string, there is provided a side bore which is closed using a plug, and a valve member which is pivotable between a first position in which the side bore is closed whilst the main bore of the drill string is open, and a second position in which the side bore is open whilst the main bore is closed. During drilling, the valve is retained in the first position, but when it is time to increase the length of the drill string, the plug is removed from the side bore, and a hose, which extends from the pump, connected to the side bore, and a valve in the hose opened so that pumping of mud into the drill string via the side bore commences. A valve in the main hose from the pump to the top of the drill string is then closed, and the pressure of the mud at the side bore causes the valve member to move from the first position to the second position, and hence to close the main bore of the drill string.

The main hose is then disconnected, the new section of tubing mounted on the drill string, and the main hose connected to the top of the new section. The valve in the main hose is opened so that pumping of mud into the top of the drill string is recommenced, and the valve in the hose to the side bore closed. The resulting pressure of mud entering the top of the drill string causes the valve member to return to its first position, which allows the hose to be removed from the side bore, without substantial leakage of mud from the drill string.

The side bore may then be sealed permanently, for example by welding a plug onto the side bore, before this section of drill string is lowered into the well.

The drill string may also be provided with a side bore in what is known as a "pump in sub", which is used in the event of an emergency, for example to facilitate the provision of additional mud pressure required to control a sudden surge in well-bore pressure due to fluid inflow from a formation penetrated by the well entering the well in what is known as a "kick".

This type of drilling is generally known as continuous circulation drilling.

SUMMARY OF THE INVENTION

This invention comprises a method of continuous circulation drilling in which the rate of circulation of drilling mud is linked to the speed of rotation of the drill pipe.

According to a first aspect of the invention we provide a method of drilling a subterranean bore hole comprising:

a) pumping a drilling fluid down a drill string, the drill string having a drill bit at an end thereof, b) rotating the drill string about its longitudinal axis to that the bit forms bore hole in the ground, the method further comprising the steps of:

c) changing the rate of pumping of the drilling fluid into the drill string in response to a change in the speed of rotation of the drill string, and/or changing the speed of rotation of the drill string in response to a change in the rate of pumping of the drilling fluid into the drill string.

The mud pressure at the bottom of the well bore (the BHP) depends on various factors. When there is no mud flow, it is determined by the pressure from the static weight of the column of mud in the well bore. When mud is pumped down the drill pipe into the well bore, there is an increase in BHP due to frictional effects from the circulating mud. It has also been discovered that commencement of drilling gives rise to a further increase in BHP arising from additional frictional effects caused by the rotation of the drill pipe. This effect is significant as it makes up a large percentage, nominally 10% to 40% of the previously described friction effect. Thus, by linking the rate of circulation of drilling mud to the speed of rotation of the drill pipe, the increase in BHP caused by an increase in the speed of rotation of the drill pipe can be countered by the decrease BHP caused by a reduction in the rate of circulation of drilling mud, or vice versa. As a result, improved control of the BHP may be achieved. This is critical requirement for drilling well with a small drilling window as determined by the pore pressure gradient, fracture gradient and collapse pressure of the borehole, which are dictated by the physical properties of the formation being drilled.

In one embodiment of the invention, the rate of pumping of the drilling fluid is increased as the speed of rotation of the drill string is decreased, and the rate of pumping of the drilling fluid is decreased as the speed of rotation of the drill string is increased, and/or the speed of rotation of the drill string is increased as the rate of pumping of the drilling fluid is decreased and the speed of rotation of the drill string is decreased as the rate of pumping of the drilling fluid is increased.

The method may further include the steps of:

d) stopping the rotation of the drill string, e) pumping drilling fluid into a side port adjacent the uppermost end of the drill string, f) ceasing pumping of drilling fluid into the uppermost end of the drill string, g) connecting a new section of drill pipe to the uppermost end of the drill string, h) commencing pumping of drilling fluid into the uppermost end of the new section of drill pipe, i) ceasing pumping of drilling fluid into the side port, and j) recommencing rotation of the drill string.

In this case, preferably the rate of pumping of fluid into the drill string is increased as the speed of rotation of the drill string is decreased in step d, and the rate of pumping of fluid into the drill string is decreased as the speed of rotation of the drill string is increased in step j.

In one embodiment of the invention, the method further comprises directing drilling fluid leaving the bore hole along an annulus return line, and varying the fluid pressure in the well bore by varying the degree of restriction of fluid flow along the annulus return line.

In one embodiment of the invention, the method further comprises measuring the pressure of fluid at the bottom of the bore hole, and altering the rotational speed of the drill string or the rate of pumping of drilling fluid into the drill string to bring the measured pressure to a desired level.

In one embodiment of the invention, the method further comprises automatically changing the rate of pumping of the drilling fluid into the drill string in response to a change in the speed of rotation of the drill string, or automatically changing the speed of rotation of the drill string in response to a change in the rate of pumping of the drilling fluid into the drill string.

According to a second aspect of the invention we provide an apparatus for drilling a bore hole comprising a drill string, a driver operable to cause rotation of the drill string along its longitudinal axis, a pump operable to pump drilling fluid into the drill string, a driver controller which is operable to control the driver to vary the speed of rotation of the drill string, and a pump controller which is operable to control the pump to vary the rate of pumping of drilling fluid into the drill string, characterised in that the driver controller and pump controller are in communication so that the pump controller automatically changes the rate of pumping of the drilling fluid into the drill string in response to a change in the speed of rotation of the drill string, and/or the driver controller automatically changes the speed of rotation of the drill string in response to a change in the rate of pumping of the drilling fluid into the drill string.

In one embodiment of the invention the driver controller is an electronic driver controller, and the pump controller is an electronic pump controller, there being an electrical connection between the driver controller and the pump controller, to provide for the transmission of a control signal between the top drive controller and the pump controller.

The pump controller is programmed to monitor this signal, and automatically to alter the speed of operation of the pump in accordance with the instruction given in the control signal. In one embodiment of the invention, the top drive controller would be programmed to send a control signal instructing the pump controller to reduce the speed of operation of the pump as the speed of rotation of the drill pipe increases, and to increase the speed of operation of the pump as the speed of rotation of the drill pipe decreases.

In this case, the driver controller is programmed to transmit to the pump controller a control signal instructing the pump controller to either increase or decrease the speed of operation of the pump depending on whether the rotational speed of the drill pipe is decreasing or increasing.

The pump controller may be programmed to monitor this signal, and automatically to alter the speed of operation of the pump in accordance with the instruction given in the control signal.

The driver controller may be programmed to send a control signal to the pump controller instructing the pump controller to reduce the speed of operation of the pump as the speed of rotation of the drill pipe increases, and to increase the speed of operation of the pump as the speed of rotation of the drill pipe decreases.

The pump controller may be provided with an input for receipt of a signal indicative of the speed of rotation of the drill pipe.

The pump controller may be programmed to respond to a signal indicating that the drill pipe speed is decreasing by increasing the speed of operation of the pump, or where more than one pump is provided, one or more of the pumps, and vice versa.

In one embodiment of the invention, the driver controller and pump controller are integrated to comprise a single electronic controller which is operable to control the speed of operation of the pump and the speed of rotation of the drill string.

In one embodiment of the invention, the controller or one or both of the controllers has a pressure input for receipt of a signal from a pressure sensor located on the drill string which transmits a signal indicative of the fluid pressure in the bore hole to the or each controller to which it is connected.

In this case, the or each controller having said pressure input is programmed to use this pressure signal to determine if the fluid pressure is at a desired level, and, if not, make further adjustments to the pump speed and/or speed of rotation of the drill string to bring the fluid pressure to the desired level or to within an acceptable range.

In one embodiment of the invention, the controller or one or both of the controllers has a flow input for receipt of a signal from a flow meter which transmits a signal representative of the rate of flow of drilling fluid down the drill string to the or each controller to which it is connected.

Alternatively a flow measurement of the fluid flow down the drillpipe by a pump stroke counter can be used as a measurement to provide input to the controller.

In one embodiment of the invention, the apparatus further includes an annulus return line which connects the annular space in the bore hole around the drill string with a reservoir for pressurised fluid, an adjustable choke in the annular return line, and an electronic choke controller which controls operation of the adjustable choke to vary the restriction of flow of fluid along the annulus return line.

In other words, the invention can be used in conjunction with existing systems that control the bottom hole pressure by backpressure control with a choke, such as the system shown in U.S. Pat. No. 7,395,878. In such a system, operation of the back-pressure control choke may be used in addition to the control of the pump speed described, above, to achieve the desired BHP.

DESCRIPTION OF THE DRAWINGS

Embodiments of the invention will now be described, by way of example only, with reference to the following drawings of which.

DESCRIPTION OF THE PREFERRED EMBODIMENTS OF THE INVENTION

Figure 1:
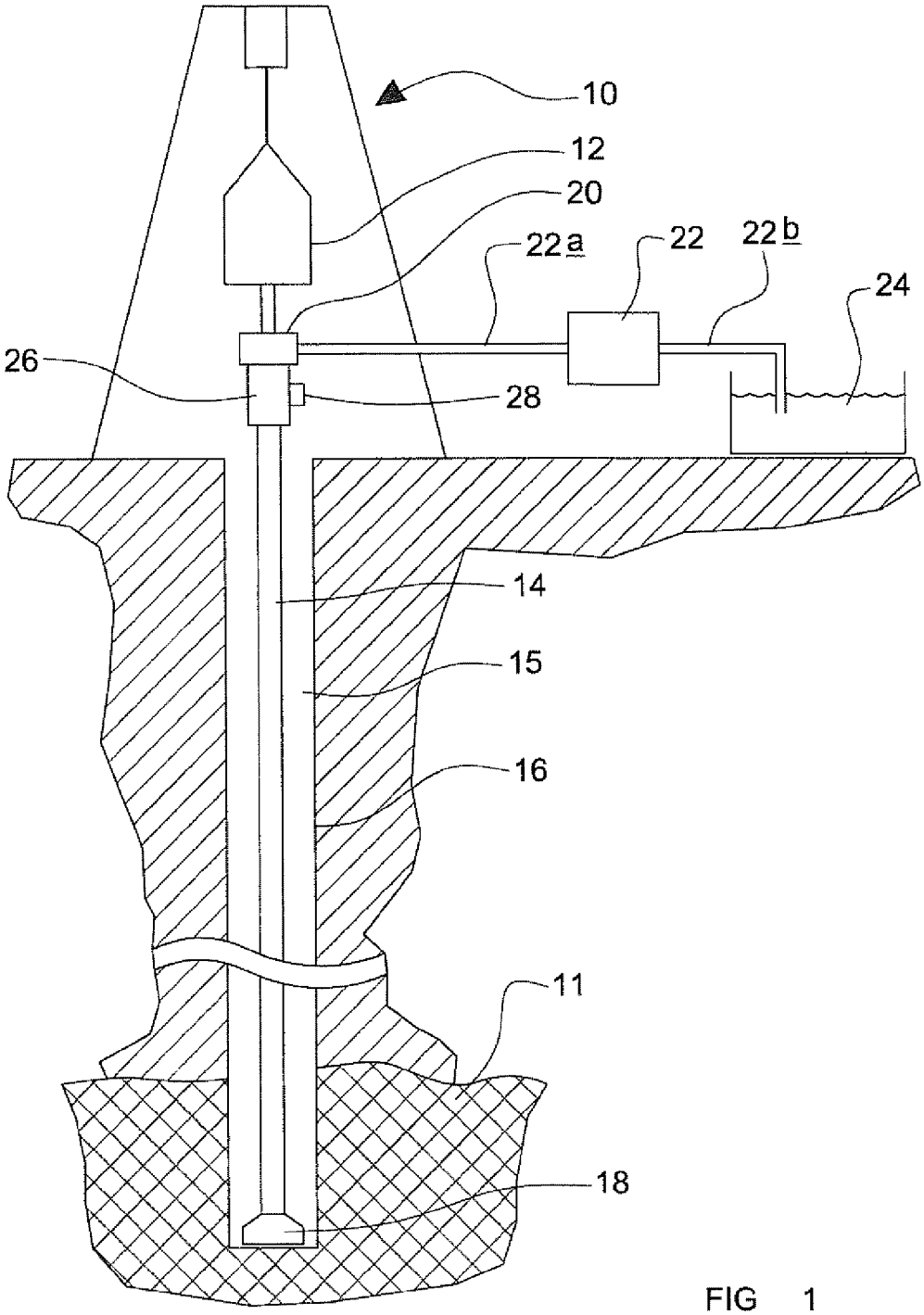
FIG. 1 is a schematic illustration of an embodiment of drilling rig operable in accordance with the invention.

Referring now to FIG. 1, there is shown a drilling rig 10 with a top drive 12 connected to a drill string 14 which extends from the drilling rig 10 down into a well bore 16. A bottom hole assembly (BHA) 18 is provided at the lowermost end of the drill string 14. The BHA 18 comprises a drill bit and various sensors including at least a pressure sensor which is operable to transmit a signal representative of the pressure of the fluid around the BHA 18. The BHA 18 may also include a downhole motor for driving rotation of the drill bit as is known in the art.

There is also shown in FIG. 1 a manifold 20 which is mounted on the uppermost end of the drill pipe 14 and which is connected to a mud pump 22 via an outlet pipe or hose 22*a*. The mud pump 22 is connected to a mud reservoir 24 via an inlet pipe or hose 22*b* such that operation of the mud pump 22 causes mud to be pumped from the mud reservoir 24 along the inlet pipe 22*b* and the outlet pipe 22*a* and into the main bore of the drill pipe 14 via the manifold 20. A conduit (not shown) is provided to return the mud to the reservoir 24 after circulation down the drill string 14, and back up the annulus 15.

The drill pipe 14 is also provided at its uppermost end with a side bore and a continuous circulation valve assembly 26 which is movable between a first position in which the main bore of the drill pipe 14 is open and the side bore is substantially closed, and a second position in which the main bore is substantially closed and the side bore is open. Examples of such valve assemblies are disclosed in U.S. Pat. No. 2,158,356, GB2426274, and GB2427217. The side bore is provided with a connector 28 by means of which an auxiliary outlet hose (not shown for clarity) from the mud pump 22 may be connected, to facilitate pumping of mud into the main bore of the drill pipe 14 via the side bore during connection of a new tubular to the uppermost end of drill pipe 14.

The top drive 12 is operable to rotate the drill string 14 about its longitudinal axis, and various embodiments of suitable top drives 12 are well known in the art. Such a top drive 12 is disclosed in U.S. Pat. No. 6,050,348, for example, and invention will be described with reference to this type of top drive.

This type of drilling rig 10 can be used in open hole drilling.

Figure 3:
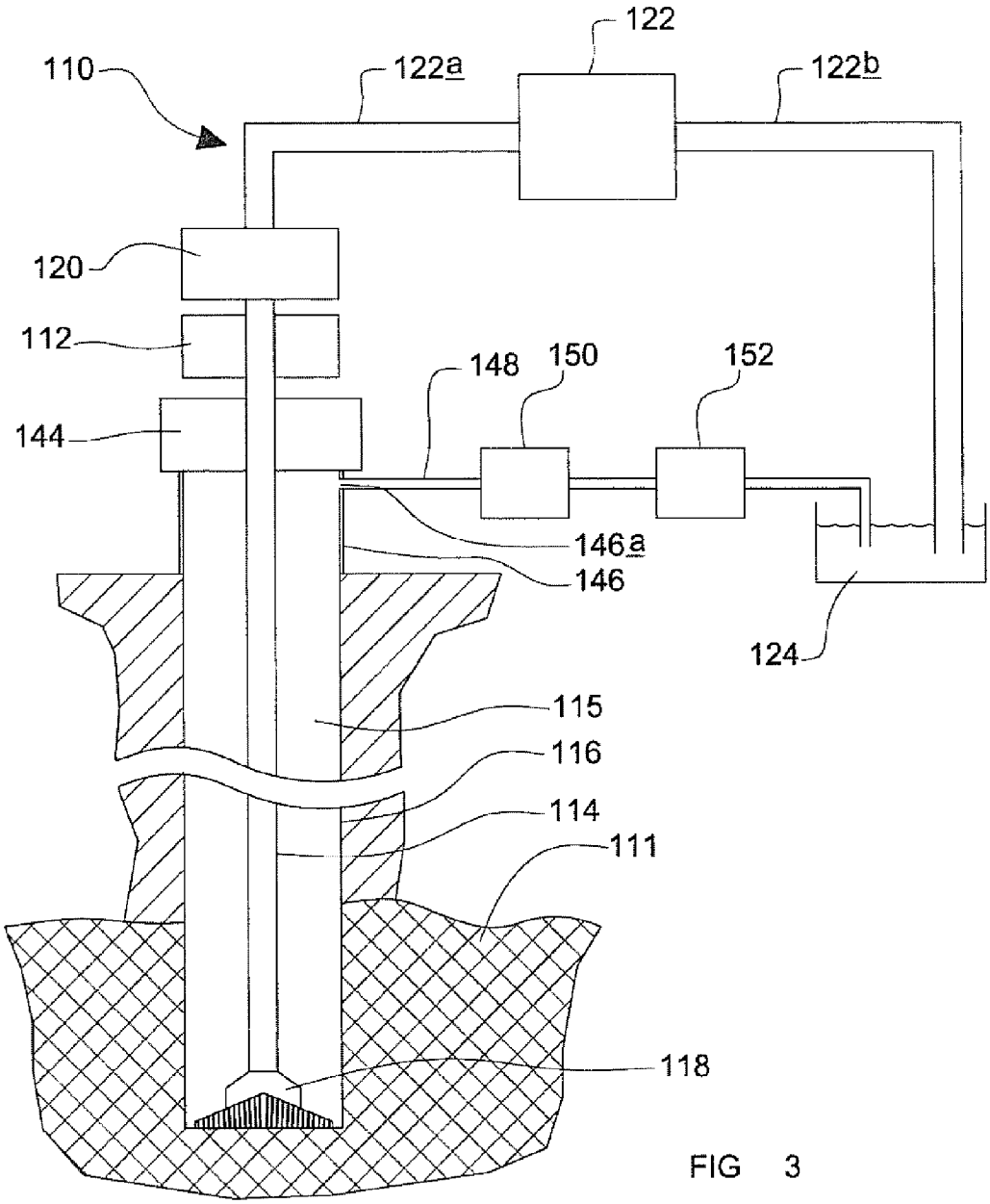
FIG. 3 is a schematic illustration of an alternative embodiment of drilling rig operable in accordance with the invention.

An alternative embodiment of drilling rig 110 which may be used to implement the invention is illustrated in FIG. 3. As in the FIG. 1 embodiment, a top drive 112 is connected to drill string 114 which extends from the drilling rig 110 down into a well bore 116. A bottom hole assembly (BHA) 118 is provided at the lowermost end of the drill string 114. In this case the manifold 120 which is connected to the mud pump 122 via an outlet pipe or hose 122*a* is mounted at the uppermost end of the drill string 114, with the top drive 112 connected to the drill string 114 below the manifold 120. The mud pump 122 is connected to a mud reservoir 124 via an outlet pipe or hose 122*b* such that operation of the pump 122 causes mud to be pumped from the mud reservoir 124 along the inlet pipe 122*b* and the outlet pipe 122*a* and into the main bore of the drill string 114 via the manifold 120.

The drill string 114 in this embodiment of the invention is also, advantageously, provided at its uppermost end with a side bore and continuous circulation valve assembly, but these are not included in the illustration, for clarity.

In this embodiment of drilling rig 10, the well bore 116 is capped with a well head 146, and a closure device 144 such as a rotating blow out preventer (BOP) or rotating control device (RCD). The drill string 114 extends through the well head 146 and closure device 144, the closure device 20 having seals which close around the exterior of the drill string 114 to provide a substantially fluid tight seal around the exterior of the drill string 114 whilst allowing the drill string to rotate about its longitudinal axis, and to be moved further down into the well bore 116. Together, the well head 146 and closure device 144 contain the fluid in the annular space around the drill string 114 (the annulus 115).

The well head 146 includes a side port 146*a* which is connected to an annulus return line 148, and which provides an outlet for fluid from the annulus 115. The annulus return line 148 extends to the reservoir 124 via an adjustable choke or valve 150 and a flow meter (such as a Coriolis flow meter) which is downstream of the choke/valve 150. Filters and/or shakers (not shown) are generally provided to remove particulate matter such as drill cuttings from the drilling fluid prior to its return to the reservoir 124.

For both embodiments of drilling rig 10, 110, during drilling, the top drive 12, 112 rotates the drill string 14, 114 about its longitudinal axis so that the drill bit cuts into the formation 11, 111, and the pump 22, 122 is operated to pump drilling fluid from the reservoir 24, 124 to the manifold 20, 120 and into the drill string 14, 114 where it flows into the annulus 15, 115 via the BHA 18, 118.

In the embodiment of drilling rig illustrated in FIG. 3, the mud and drill cuttings flow up the annulus 115 to the well head 146, and into the annulus return line 148, and the adjustable choke or valve 150 may be operated to restrict flow of the drill fluid along the annulus return line 148, and, therefore, apply a back-pressure to the annulus 115. This back-pressure may be increased until the fluid pressure at the bottom of the well bore 116 (the bottom hole pressure) is deemed sufficient to contain the formation fluids in the formation 111 whilst minimizing the risk of fracturing the formation or causing drilling fluid to penetrate the formation. The rate of flow of fluid out of the annulus 115 is monitored using the flow meter 152, and compared with the rate of flow into the drill string 114, and this data may be used to detect a kick or loss of drilling fluid to the formation.

This type of drilling is known as managed pressure drilling (MPD) and is disclosed in U.S. Pat. No. 6,575,244, U.S. Pat. No. 7,044,237, and U.S. Pat. No. 7,395,878, for examples. The invention provides a means of control of the BHP using the open hole drilling rig shown in FIG. 1, and an additional means of control of the BHP in managed pressure drilling as described above in relation to FIG. 3.

Figure 2:
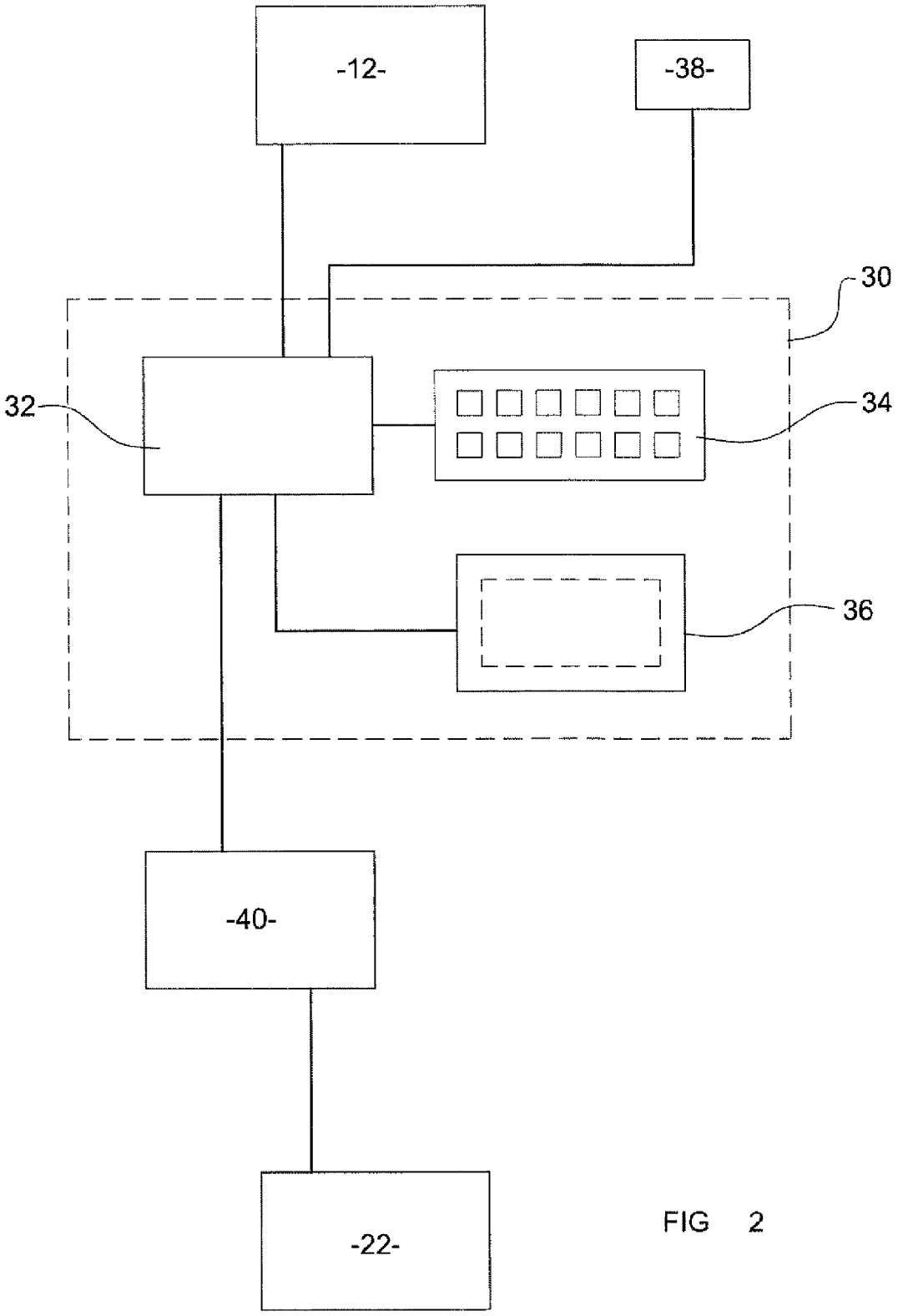
FIG. 2 is a schematic illustration of an embodiment of control apparatus which may be used in operating the drilling rig shown in FIG. 1 in accordance with the invention.

FIG. 2 shows a schematic illustration of an embodiment of control apparatus which may be used in controlling the operation of either of the drilling rigs 10, 110 shown in FIG. 1 or 3. In these embodiments of the invention, the operation of the top drive 12, 112 is controlled by means of an electronic control unit (ECU) 30 which in this example comprises a microprocessor 32, an input device 34 such as a keyboard, or joystick and a display device 36 such as a monitor.

There is also provided a rotational speed sensor 38 which is operable to provide an electrical signal representative of the speed of rotation of the drill string 14, 114. The rotational speed sensor 38 may, for example, be an inductive sensor as described in U.S. Pat. No. 6,050,348, but any other device which detects and measures the speed of rotation of an object may be used instead. The speed sensor 38 is electrically connected to the microprocessor 32 so that the electrical signal generated by the speed sensor 38 which is representative of the speed of rotation of the drill string 14, 114 may be transmitted to the microprocessor 32.

The microprocessor 32 is programmed as described in U.S. Pat. No. 6,050,348 to vary the speed of rotation of the drill string 14. 114, and an operator may use the input device 34 to instruct the microprocessor 32 to alter the speed of rotation of the drill pipe string 14, 114. For example, an operator may use the input device 34 to stop the rotation of the drill string 14, 114 when it is desired to connect a new portion of tubular to the top of the drill string 14, 114.

There is also provided a further electronic control unit (the pump ECU) 40 by means of which the speed of operation of the mud pump 22, 122 is controlled. Such electronically controlled pumps are also well known in the art.

In this embodiment of the invention, the microprocessor 32 of the top drive ECU 30 is electrically connected to the pump ECU 40, and is programmed to transmit to the pump ECU 40 a control signal instructing the pump ECU 40 to either increase or decrease the speed of operation of the pump 22, 122. The pump ECU 40 is programmed to monitor this signal, and automatically to alter the speed of operation of the pump 22, 122 in accordance with the instruction given in the control signal. In this embodiment of the invention, the microprocessor 32 of the top drive ECU 30 is programmed to send a control signal instructing the pump ECU 40 to reduce the speed of operation of the pump 22, 122 as the speed of rotation of the drill string 14, 114 (as determined using the signal from the speed sensor 38) increases, or to increase the speed of operation of the pump 22, 122 as the speed of rotation of the drill string 14, 114 decreases.

In an alternative embodiment of the invention the microprocessor 32 of the top drive ECU 30 may have a further input for an electrical pressure signal from a pressure sensor provided on the BHA 18, 118. In this case, the microprocessor 32 could be programmed to monitor the pressure signal, and modify the control signal in accordance with the pressure signal. For example, if, when the speed of rotation of the drill pipe 14 is decreasing, and the microprocessor 32 is transmitting to the pump ECU 40 a control signal instructing the pump ECU 40 to increase the pump speed, if the pressure signal from the pressure sensor indicates that the BHP is actually decreasing the microprocessor 32 could be programmed to modify the control signal to instruct the pump ECU 40 to increase the pump speed at a faster rate. Alternatively, if the pressure signal from the pressure sensor indicates that the BHP is actually increasing, the microprocessor 32 could be programmed to modify the control signal to instruct the pump ECU 40 to increase the pump speed at a slower rate. Similarly, if, when the speed of rotation of the drill pipe 14 is increasing, and the microprocessor 32 is transmitting to the pump ECU 40 a control signal instructing the pump ECU 40 to decrease the pump speed, if the pressure signal from the pressure sensor indicates that the BHP is actually decreasing the microprocessor 32 could be programmed to modify the control signal to instruct the pump ECU 40 to decrease the pump speed at a slower rate. Alternatively, if the pressure signal from the pressure sensor indicates that the BHP is actually increasing, the microprocessor 32 could be programmed to modify the control signal to instruct the pump ECU 40 to decrease the pump speed at a faster rate.

It should be appreciated that the invention could be implemented in other ways. For example, the pump ECU 40 could be electrically connected to the speed sensor 38 so as to receive directly the signal indicative of the speed of rotation of the drill pipe 14. In this case, the pump ECU 40 would be programmed to reduce the speed of operation of the pump 22 as the speed of rotation of the drill pipe 14 (as determined using the signal from the speed sensor 38) increases, or to increase the speed of operation of the pump 22 as the speed of rotation of the drill pipe 14 decreases. Alternatively, the top drive ECU 30 and pump ECU 40 may share a common microprocessor which is programmed to operate as described above.

For implementing this invention algorithms can be developed that calculate the effect that pipe rotation friction F(pr) has on the total friction factor F(T). The other component of friction is the wellbore friction factor F(wb).

These friction factors are not linear and to reliably model such a system is a complex process as there are many variables like pipe geometry, wellbore geometry, drillpipe roughness, wellbore roughness, mud properties (Newtonian vs non-newtonian fluids, viscocity, etc.), temperature which effect the frictional forces present.

A relatively simple method for one skilled in the art of drilling wells is to carry out a calibration exercise with the system to determine the relationship between the pipe rotational speed and its effect on BHP. This calibration can be carried out at intervals while drilling down the well, usually just after the last casing (steel pipe) isolating the wellbore has been placed and cemented.

The procedure would require a pressure measurement near the bottom as is commonly used and termed in the industry as PWS (Pressure While Drilling)

With a steady pump rate of fluid being pumped, a series of stepped measurements are made with drillpipe rotation increased in steps of 20 revolutions per minute (rpm) from 0 to the maximum (usually 200 rpm).

These ten steps can be repeated for 5 to 10 different pump rates from 0 gallons per minute (gpm) to the maximum planned for drilling that section.

This would produce a series of calibration data that can be entered into the microprocessor 32, and with this information the system can determine how to adjust the speed of operation of the pump in response to changes in pipe rotation to and still achieve the desired BHP.

Alternatively, mathematical models linking the drill pipe rotational speed to the BHP, such as those disclosed in SPE 135587 ("The Effect of Drillstring Rotation on Equivalent Circulation Density: Modeling and Analysis of Field Measurements", Ramadan Ahmed et al) or SPE 20305 ("Reduction of the Annular Friction Pressure Drop Caused by Drillpipe Rotation", Yuejin Luo and J. M. Peden) may be used by the controller to determine how a change in drill pipe speed will effect the BHP, and therefore what change in pump speed is required to counterbalance this.

It should be appreciated, that when applied during managed pressure drilling as described above in relation to FIG. 3, this method control of the BHP can be used in addition to the control provided by the operation of the adjustable choke or valve 150. Typically control of the adjustable choke or valve 150 is carried out electronically using an ECU, and this ECU may be combined with the top drive ECU 30 and/or the pump ECU 40.

It will be appreciated that control of the BHP by linking the speed of rotation of the drill string 14, 114 with the pumping rate is particularly advantageous in continuous circulation drilling. As described above, rotation of the drill string 14, 114 is stopped during the connection of a new section of drill pipe, and so, according to the invention, the pump speed can be increased as the speed of rotation of the drill string 14, 114 is decreased, in order to maintain the BHP at the desired level. After the connection has been made, the pump speed can be decreased as rotation of the drill string 14, 114 recommences.

Whilst in these embodiment of drilling rig 10, 110, the use of a top drive 12, 112 is disclosed, it should be appreciated that the principles of this invention apply to any system for driving rotation of the drill string 14, 114, including a rotary table, for example. Moreover, although this invention has been described with reference to the use of a single mud pump 22, 122, a plurality of mud pumps may be used with one or more than one of these being controlled in accordance with the invention.

This invention can be enhanced by any device or coating that increases or decreases the friction factor F(pr). For example, a Teflon™ coated pipe could be used to reduce the frictional effects of the rotating drill pipe on the BHP, or vanes on the drillpipe body could be used to increase the frictional effects of the rotating drill pipe.

When used in this specification and claims, the terms "comprises" and "comprising" and variations thereof mean that the specified features, steps or integers are included. The terms are not to be interpreted to exclude the presence of other features, steps or components.

The invention claimed is:

1. A method of drilling a subterranean bore hole, the method comprising the steps of:

a) pumping a drilling fluid down a drill string, the drill string having a drill bit at an end thereof, b) rotating the drill string about its longitudinal axis so that the bit forms a bore hole in the ground, c) performing at least one step from the group consisting of:

increasing the rate of pumping of the drilling fluid as the speed of rotation of the drill string is decreased, decreasing the rate of pumping of the drilling fluid as the speed of rotation of the drill string is increased, increasing the speed of rotation of the drill string as the rate of pumping of the drilling fluid is decreased, decreasing the speed of rotation of the drill string as the rate of pumping of the drilling fluid is increased, and combinations thereof, and d) operating an adjustable choke in an annulus return line, the annulus return line connecting an annular space in the bore hole around the drill string with a reservoir for pressurized fluid, so as to vary a restriction of fluid flow along the annulus return line.

2. The method of claim 1, further comprising the steps of:

e) stopping the rotation of the drill string, f) pumping the drilling fluid into a side port adjacent an uppermost end of the drill string, g) ceasing pumping of the drilling fluid into the uppermost end of the drill string, h) connecting a new section of drill pipe to the uppermost end of the drill string, i) commencing pumping of the drilling fluid into the uppermost end of the new section of drill pipe, j) ceasing pumping of the drilling fluid into the side port, and k) recommencing rotation of the drill string.

3. The method of claim 2 wherein the rate of pumping of the drilling fluid into the drill string is increased as the speed of rotation of the drill string is decreased in step e, and the rate of pumping of the drilling fluid into the drill string is decreased as the speed of rotation of the drill string is increased in step k.

4. The method of claim 1 further comprising directing drilling fluid leaving the bore hole along the annulus return line, and varying the fluid pressure in the well bore by varying the degree of the restriction of fluid flow along the annulus return line.

5. The method according to claim 1, the method further comprising measuring the pressure of fluid at the bottom of the bore hole, and altering at least one of the rotational speed of the drill string and the rate of pumping of drilling fluid into the drill string to bring the measured pressure to a desired level.

6. The method according to claim 1, the method further comprising at least one of changing the rate of pumping of the drilling fluid into the drill string in response to a change in the speed of rotation of the drill string, and changing the speed of rotation of the drill string in response to a change in the rate of pumping of the drilling fluid into the drill string.

7. An apparatus for drilling a bore hole, the apparatus comprising:

a drill string having a longitudinal axis, a driver operable to cause rotation of the drill string along the longitudinal axis, a pump operable to pump drilling fluid into the drill string, a driver controller, the driver controller being operable to control the driver to vary the speed of rotation of the drill string, a pump controller, the pump controller being operable to control the pump to vary the rate of pumping of drilling fluid into the drill string, and the driver controller and pump controller being in communication so that the pump controller and the driver controller perform one or more operations selected from a group consisting of:

the pump controller increasing the rate of pumping of the drilling fluid into the drill string in response to a decrease in the speed of rotation of the drill string, the driver controller changing the speed of rotation of the drill string, and the pump controller decreasing the rate of pumping of the drilling fluid into the drill string in response to an increase in the speed of rotation of the drill string, and and/or the driver controller increasing the speed of rotation of the drill string in response to a decrease in the rate of pumping of the drilling fluid into the drill string, and the driver controller decreasing the speed of rotation of the drill string in response to an increase in the rate of pumping of the drilling fluid, wherein, the driver controller is an electronic driver controller, and the pump controller is an electronic pump controller, there being an electrical connection between the driver controller and the pump controller, to provide for the transmission of a control signal between the driver controller and the pump controller, and further comprising an annulus return line which connects the annular space in the bore hole around the drill string with a reservoir for pressurized fluid, an adjustable choke in the annular return line, and an electronic choke controller which controls operation of the adjustable choke to vary the restriction of flow of fluid along the annulus return line.

8. An apparatus according to claim 7, wherein the driver controller is programmed to transmit to the pump controller a control signal instructing the pump controller to either increase or decrease the speed of operation of the pump depending on whether the rotational speed of the drill pipe is decreasing or increasing.

9. An apparatus according to claim 8, wherein the pump controller is programmed to monitor the control signal, and to alter the speed of operation of the pump in response to the instruction given in the control signal.

10. An apparatus according to claim 9, wherein the driver controller is programmed to send a control signal to the pump controller instructing the pump controller to reduce the speed of operation of the pump as the speed of rotation of the drill pipe increases, and to increase the speed of operation of the pump as the speed of rotation of the drill pipe decreases.

11. An apparatus according to claim 7, wherein the pump controller is provided with an input for receipt of a signal indicative of the speed of rotation of the drill pipe.

12. An apparatus according to claim 11, wherein the pump controller is programmed to respond to a signal indicating that the drill pipe speed is decreasing by increasing the speed of operation of the pump, and to respond to a signal indicating that the drill pipe speed is increasing by decreasing the speed of operation of the pump.

13. An apparatus according to claim 7 wherein the driver controller and pump controller are integrated to comprise a single electronic controller which is operable to control the speed of operation of the pump and the speed of rotation of the drill string.

14. An apparatus according to claim 7 wherein at least one of the pump controller and the driver controller further comprise a pressure input for receipt of a pressure signal, and wherein the drill string has a pressure sensor located thereon and connected to the pressure input, the pressure sensor transmitting the pressure signal to the pressure input, the pressure signal being indicative of the fluid pressure in the bore hole.

15. An apparatus according to claim 14 wherein at least one of the pump controller and the driver controller having said pressure input is programmed to use the pressure signal to determine if the fluid pressure is at a desired level, and, if not, make further adjustments to at least one of the pump speed and speed of rotation of the drill string to bring the fluid pressure to the desired level or to within an acceptable range.

16. An apparatus according to claim 7 wherein at least one of the pump controller and the driver controller comprises a flow input for receipt of a flow signal, and wherein a flow meter is positioned to detect the rate of flow of the drilling fluid down the drilling string and is connected to the flow input, the flow meter transmitting the flow signal to the flow input, the flow signal being representative of the rate of flow of drilling fluid down the drill string.

* * * * *